US005287862A

United States Patent [19]

Pruyne

[11] Patent Number: 5,287,862

[45] Date of Patent: Feb. 22, 1994

[54] DEVICE FOR SLOWING THE BURNING OF A RESTING CIGARETTE

[75] Inventor: Jerry R. Pruyne, Salt Lake City, Utah

[73] Assignee: Innovative Industries, Inc., Salt Lake City, Utah

[21] Appl. No.: 764,315

[22] Filed: Sep. 24, 1991

[51] Int. Cl.[5] ..... A24F 13/22; A24F 19/00

[52] U.S. Cl. ..... 131/240.1; 131/235.1; 131/241

[58] Field of Search ..... 131/240.1, 241, 235.1, 131/256

[56] References Cited

U.S. PATENT DOCUMENTS

| | | | |
|---|---|---|---|
| 2,111,172 | 3/1938 | Cook | 131/235.1 |
| 2,404,174 | 7/1946 | Hines | 131/235.1 |
| 4,108,153 | 8/1978 | Pearson | 131/235.1 |
| 4,239,049 | 12/1980 | Perry . | |
| 4,241,742 | 12/1980 | Hilding | 131/240.1 X |
| 4,920,988 | 5/1990 | Cancellara | 131/240.1 X |
| 4,982,746 | 1/1991 | Pruyne . | |
| 5,020,549 | 6/1991 | Wojcik | 131/241 X |

FOREIGN PATENT DOCUMENTS

| | | | |
|---|---|---|---|
| 664825 | 6/1963 | Canada | 131/235.1 |
| 837482 | 4/1952 | Fed. Rep. of Germany | 131/235.1 |
| 2443810 | 7/1980 | France | 131/235.1 |
| 2594302 | 8/1987 | France | 131/256 |

*Primary Examiner*—V. Millin
*Assistant Examiner*—J. Doyle
*Attorney, Agent, or Firm*—Mallinckrodt & Mallinckrodt

[57] ABSTRACT

A device for slowing the burning and smoke output of a resting cigarette between drags thereon by a smoker includes a base with an inclined or sloped open channel therein shaped to closely receive and cradle the burning end of a cigarette around about one-half the circumference of the cigarette. The cigarette is held in a sloped condition with the burning end downwardly. A passage extending along the length of the channel serves to provide air to the cigarette in addition to the air provided by the open side of the channel. The passage is dimensioned to provide a controlled amount of air to the cigarette and the dimensions of the passage may vary along its length to vary the amount of air supplied to the burning end of the cigarette depending upon its position in the channel.

16 Claims, 2 Drawing Sheets

DEVICE FOR SLOWING THE BURNING OF A RESTING CIGARETTE

BACKGROUND OF THE INVENTION

1. Field:

The invention is in the field of ash trays.

2. State of the Art:

Ash trays in use today provide a receptacle for ashes from cigarettes as they burn and for cigarette butts after smoking of the cigarette has been completed. Ash trays usually also provide a rest for cigarettes to hold the cigarette as it burns, when not being smoked, but when the smoker desires to keep it lit and available for smoking.

With the current concern for reducing the smoke in the air that non-smokers breath, it would be desirable to reduce the amount of smoke released by a cigarette while not being smoked by a smoker, for example, the smoke released by a cigarette while resting in an ash tray between drags by a smoker.

In my U.S. Pat. No. 4,982,746 I disclose that the smoke output of a cigarette may be reduced as it sits in an ash tray by providing a channel in which the cigarette may be placed and which fits closely about the outside of the cigarette for at least a third of the circumference of the cigarette, and preferably for a half of the circumference of the cigarette. While this channel is effective to reduce smoke output, I have found that it can cause discoloration of the cigarette. Further, it does not result in the controlled burning necessary to ensure that the cigarette can be picked up and smoked normally after being in the channel for an extended time.

SUMMARY OF THE INVENTION

According to the invention, a device for slowing the burning and smoke output of a resting cigarette includes a base, preferably in the form of an ash tray, with an inclined open channel therein within which to rest a burning cigarette. Means in addition to the open side of the channel is provided to supply air to the burning end of the cigarette and preferably takes the form of a passage extending along the length of the channel, and on the side thereof opposite the open side. The passage may vary in dimensions so as to progressively supply more air to the burning end of the cigarette as such end continues to burn and move along the passage when the burning end reaches a predetermined position at along the passage, the passage supplies less air to the burning end causing the cigarette to go out.

It has been found that the incline of the channel, at least three degrees and preferably six degrees, in combination with the controlled burning, allows the tars to flow to the burning end of the cigarette where they are burned so do not flow to the bottom side of the cigarette in the channel, condense, and discolor the cigarette. Such condensation on the cigarette also adversely affects the flavor of the cigarette for additional smoking. Further, it has been found that the additional air supplied by the passage keeps the cigarette burning evenly and the increase in air supplied compensates for the build-up of ash as the cigarette burns which would otherwise reduce the flow of air to the burning end.

THE DRAWINGS

In the accompanying drawings, which illustrate the best mode presently contemplated for carrying out the invention in practice:

FIG. 1 is a perspective view of an ash tray incorporating the present invention;

FIG. 2, a top plan view of the ash tray of FIG. 1;

FIG. 3, a vertical section taken on the line 3—3 of FIG. 2;

FIG. 4, a vertical section similar to that of FIG. 3, but showing a cigarette received in the channel;

FIG. 5, a vertical section taken on the line 5—5 of FIG. 4; and

FIG. 6, a top plan view of an alternate embodiment of an ash tray incorporating the invention.

DETAILED DESCRIPTION OF THE ILLUSTRATED EMBODIMENT

Figure 3:
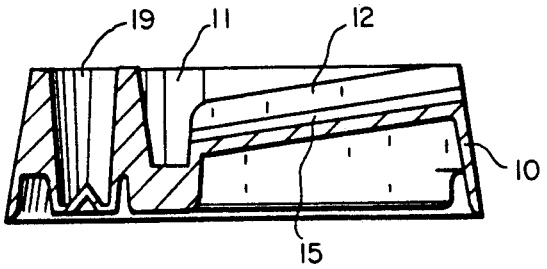
Figure 4:
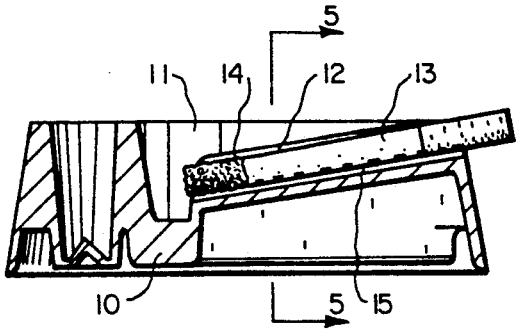

As illustrated, the device of the invention is shown in the form of an ash tray and includes a base 10 with an ash receiving recess 11 formed therein. An open channel 12 is formed in the base and is formed so that with the base 10 on a level surface, channel 12 is inclined downwardly into the ash receiving recess, see particularly FIGS. 3 and 4. The channel is adapted to receive and cradle a burning cigarette 13 therein, FIGS. 4 and 5, with the burning end 14 of the cigarette pointed downwardly. This has been found to be important so that the tar released in the cigarette will flow downwardly to the burning end of the cigarette rather than flowing to the paper on the side of the cigarette and condensing thereon to discolor the cigarette and adversely affect the taste as the cigarette is later smoked. The latter may happen if the cigarette is maintained in a horizontal position and the burning slowed to an extent sufficient to reduce the smoke output. It has been found that at the lower burning temperature when the burning is slowed, a minimum incline or slope of three degrees is necessary to keep the tars flowing to the burning end of the cigarette, with a slope of about six degrees preferred.

It has also been found that to maintain a desired burning temperature in the burning end of the cigarette so that burning is maintained at a significantly reduced smoke level, it is necessary that the channel fit closely about the cigarette around about one-half of its circumference. Also,, air should be supplied to the burning end of the cigarette in addition to the air available from the open side of the channel. This additional air is preferably supplied to the cigarette on the side of the channel opposite the open side, usually at the bottom of the channel. As shown in FIGS. 2–5, the addition air may advantageously be supplied by a passage 15 extending along the bottom of the channel.

It is desirable to initially restrict the air to the burning end of the cigarette to a substantial extent to quickly reduce the temperatures of the burning end to that which will just maintain burning. It has been found, however, that once the temperature has been reduced,, additional air is necessary to maintain this lower temperature burning and to keep the cigarette from going out completely. Further, it has been found preferable to supply progressively additional amounts of air to the burning end. The desireability of supplying progressively more air to the burning end of the cigarette as it burns is probably because as the end of the cigarette burns, ash builds up, and it is more difficult for the air to flow through the ash to the site of combustion to maintain the same degree of burning. The additional air may be supplied to the burning end of the cigarette by making the passage 15 wider as it extends along the length of channel 12. Thus, as shown, passage 15 is narrow at its lower end 15*a*, FIG. 2, and gets progressively wider as it extends along channel 12, until it reaches an intermediate position 15*b*. The passage then narrows again and has constant width from position 15*b* to its upper end 15*c*. The depth of the passage remains the same throughout its length. With this arrangement, when a cigarette is placed in the channel with its burning end near the end of the channel, the restricted air supplied to the end of the cigarette through the open side of the channel and passage 15 causes initial rapid cooling of the burning end of the cigarette. This significantly reduces the rate of burning and the smoke output. As the cigarette continues to burn, progressively more air is provided to the burning end of the cigarette because the passage 15 in contact with the burning end progressively gets wider. This maintains the cigarette burning at its reduced rate, but prevents it from going out. However, as the burning end burns progressively toward the unburned end of the cigarette, it reaches a point where it is desirable to cause the cigarette to go out. Therefore, at this predetermined position, indicated as 15*b* in FIG. 2, air passage 15 again narrows. As the cigarette burns beyond this position, it will go out.

Figure 5:
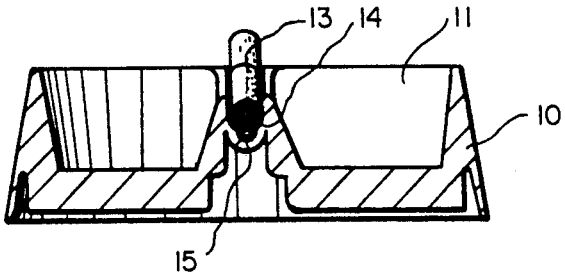

The air supplied to the burning end of the cigarette should be sufficient to keep the cigarette burning at a reduced temperature giving reduced smoke output, but at a temperature so that with a drag by a smoker on the cigarette, it will immediately come up to normal smoking temperature and smoke normally. In order to sufficiently reduce the air supplied to the cigarette, it is necessary that the channel fit closely around about one-half of the cigarette. It is thus preferable, as shown in FIG. 5, that the channel be semicircular in configuration and be of a diameter just larger than the diameter of a normal cigarette. For use with a cigarette having a 5/16 inch diameter, channel 12 should have a diameter of just over 5/16 inch so the cigarette may be easily placed in the channel. It is also preferred that the sides of the channel extend upwardly beyond the top of the cigarette as shown in FIG. 5. There is some trade off available between the closeness of fit of the channel around the cigarette and the depth of the channel. The less close the fit, the deeper the channel must be to provide the desired reduction in burning and smoke output.

With a channel extending about a cigarette as shown in FIG. 5, it has been found that a passage 15 which is 0.04 inches deep and 0.04 inches wide at point 15*a*, which widens to about 0.12 inches at point 15*b*, and then narrows to 0.06 inches from point 15*b* to end 15*c*, is satisfactory. These dimensions may vary and some experimentation is necessary to balance all factors and achieve the desired burning rate for any particular embodiment of channel and passage.

Figure 1:
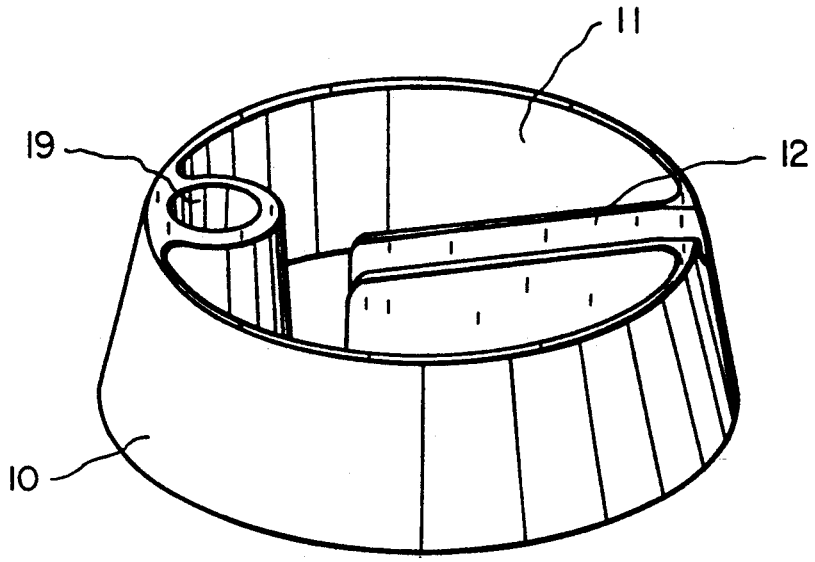
Figure 2:
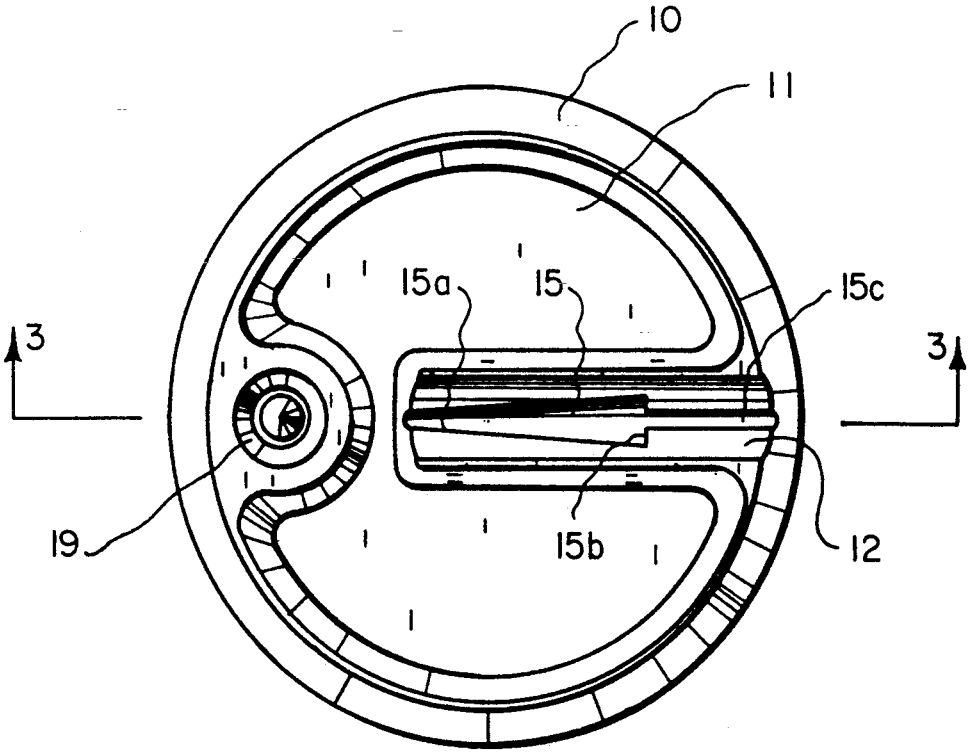
Figure 6:
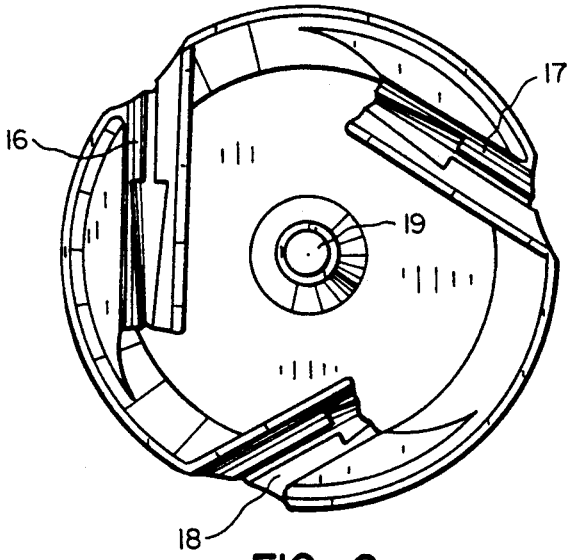

As shown in FIGS. 1 and 2, an ash tray may be provided with a single channel. In such instance, the channel should be long enough to support a cigarette of varying lengths therein with the burning end in the channel. Generally a length of between 1.75 and 2.25 inches will be satisfactory. As shown in FIG. 6, an ash tray may be provided with a plurality of channels, such as the three channels 16, 17, and 18 shown, each of different length so as to specifically accommodate cigarettes of differing lengths. The ash trays may also include a device 19 as disclosed in my referenced patent for substantially immediately extinguishing a cigarette when desired.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A device for slowing the burning and smoke output of a resting cigarette between drags thereon by a smoker, comprising a base; an open channel having an open side and a length formed in the base to receive at least a portion of a burning cigarette therein and to support the cigarette therein with one end of the channel adapted to receive the burning end portion of the cigarette, the channel being dimensioned to closely receive and cradle the portion of a standard size cigarette received therein and to extend circumferentially around at least about a half of the circumference of a standard size cigarette received therein, and said channel being formed in the base so that with the base resting on a flat surface, the channel will be inclined with the end thereof adapted to receive the burning end portion of the cigarette being downwardly; and an air passage extending along the side of the channel opposite its open side, said air passage being configured to provide progressively more air to the burning end of the cigarette as the cigarette continues to burn in the channel from the end thereof adapted to receive the burning end portion of the cigarette to an intermediate point along the length of the channel and to then reduce the air provided to the burning end of the cigarette beyond the intermediate point.

2. A device for slowing the burning and smoke output of a resting cigarette according to claim 1, wherein a plurality of channels of varying length are formed in the base to accommodate cigarettes that have been smoked to different lengths.

3. A device for slowing the burning and smoke output of a resting cigarette according to claim 2, wherein the base includes a recess therein for receiving ashes from a cigarette and the channel opens into the recess at its lower end and opens to the edge of the base at its other end.

4. A device for slowing the burning and smoke output of a resting cigarette according to claim 1, wherein the channel is inclined at an angle of at least three degrees.

5. A device for slowing the burning and smoke output of a resting cigarette according to claim 4, wherein the channel is inclined at an angle of six degrees.

6. A device for slowing the burning and smoke output of a resting cigarette between drags thereon by a smoker, comprising a base; a plurality of open channels of varying length formed in the base, each channel having an open side and formed to receive at least a portion of a burning cigarette therein and to support the cigarette therein with one end of each channel adapted to receive the burning end portion of the cigarette, each channel being dimensioned to closely receive and cradle the portion of a standard size cigarette received therein and to extend circumferentially around at least about a half of the circumference of a standard size cigarette received therein, each said channel being formed in the base so that with the base resting on a flat surface, the channel will be inclined with the end thereof adapted to receive the burning end portion of the cigarette being downwardly means for providing air to the cigarette resting in the channel in addition to the air supplied by the open side of the channel.

7. A device for slowing the burning and smoke output of a resting cigarette according to claim 6 wherein the means to provide air to the cigarette resting in a channel is an air passage extending along a channel.

8. A device for slowing the burning and smoke output of a resting cigarette according to claim 7, wherein the air passage extends along the side of the channel opposite its open side.

9. A device for slowing the burning and smoke output of a resting cigarette according to claim 8, wherein the air passage varies in dimension along its length so as to vary the amount of air supplied to the burning end of the cigarette in the channel depending upon the location of the burning end along the channel.

10. A device for slowing the burning and smoke output of a resting cigarette according to claim 9, wherein the varying dimension of the air passage is such to provide progressively more air to the burning end of the cigarette as the cigarette continues to burn in the passage.

11. A device for slowing the burning and smoke output of a resting cigarette according to claim 10, wherein the varying dimension of the air passage is such to reduce the air provided to the cigarette when the burning end reaches a predetermined position in the channel, after having progressively more air supplied thereto.

12. A device for slowing the burning and smoke output of a resting cigarette according to claim 11, wherein the width of the passage is the dimension of the passage that varies along the length of the channel.

13. A device for slowing the burning and smoke output of a resting cigarette according to claim 12, wherein the channel is inclined at an angle of at least three degrees.

14. A device for slowing the burning and smoke output of a resting cigarette according to claim 13, wherein the channel is inclined at an angle of six degrees.

15. A device for slowing the burning and smoke output of a resting cigarette according to claim 1, wherein the passage extends for the entire length of the channel.

16. A device for slowing the burning and smoke output of a resting cigarette according to claim 1, wherein the passage progressively increases in width from the end of the channel adapted to receive the burning end portion of the cigarette to the intermediate point to thereby provide progressively more air to the cigarette, and decreases in width at the intermediate point to thereby reduce the air supplied to the cigarette beyond the intermediate point.

* * * * *